US006963653B1

(12) United States Patent
Miles

(10) Patent No.: US 6,963,653 B1
(45) Date of Patent: Nov. 8, 2005

(54) HIGH-ORDER DIRECTIONAL MICROPHONE DIAPHRAGM

(75) Inventor: Ronald Miles, Newark Valley, NY (US)

(73) Assignee: The Research Foundation of the State University of New York, Albany, NY (US)

( * ) Notice: Subject to any disclaimer, the term of this patent is extended or adjusted under 35 U.S.C. 154(b) by 176 days.

(21) Appl. No.: 10/691,059

(22) Filed: Oct. 22, 2003

(51) Int. Cl.[7] ..... H04R 25/00
(52) U.S. Cl. ..... 381/424; 381/175; 381/431
(58) Field of Search ..... 381/170–176, 381/181–182, 423–424, 431, 152

(56) References Cited

U.S. PATENT DOCUMENTS 1,663,256 A * 3/1928 Lindsey ..... 381/152
1,749,635 A * 3/1930 Gerlach ..... 381/431
5,652,801 A * 7/1997 Paddock ..... 381/173
6,788,796 B1 * 9/2004 Miles et al. ..... 381/357

* cited by examiner

*Primary Examiner*—Suhan Ni
(74) *Attorney, Agent, or Firm*—Mark Levy & Associates, PLLC; David L. Banner

(57) ABSTRACT

The invention features a miniature, second-order, microcrystalline silicon microphone diaphragm formed using silicon microfabrication techniques. The diaphragm is composed of two or more rigid diaphragm elements hinged to one another providing second- or higher-order response depending on the number of diaphragm elements used. The response of the differential diaphragm has a response that is highly dependent on the direction of the incident sound. The diaphragms are useful for constructing highly innovative microphones that have far greater directionality, better sensitivity, wider frequency response, and lower noise than is achievable with current technology.

5 Claims, 8 Drawing Sheets

HIGH-ORDER DIRECTIONAL MICROPHONE DIAPHRAGM

This application results from work performed under contracts from agencies of the United States Government, including DARPA Contract No. DAAD17-00-C-0149 and NIH contract R01 DC03926-02.

RELATED APPLICATIONS

This application is related to co-pending U.S. patent application Ser. No. 09/920,664 for DIFFERENTIAL MICROPHONE, filed Aug. 1, 2001, which is included herein by reference.

FIELD OF THE INVENTION

This invention pertains to microphones and, more particularly, to a miniature microphone diaphragm having a response that is highly dependent on the direction of the incident sound.

BACKGROUND OF THE INVENTION

The creation of an acoustic pressure sensor having an output depending on the direction of the acoustic propagation requires the sensing of the acoustic pressure gradient. Currently, there are two approaches commonly used to achieve directional acoustic sensing. One approach consists of using a matched pair of non-directional microphones 102, 104 that sample the sound at two points separated by a distance, d 106, as shown in FIG. 1. The signals from these microphones are electronically processed to achieve the desired directivity. Another approach consists of constructing a single directional microphone 108 in which the two sides of the microphone diaphragm 110, 112 receive sound pressure from separate ports 115, 116 on the exterior, as shown in FIG. 2*a*. Typically, the sound from one port is delayed by a resistive material (not shown) to achieve a desired directivity.

Unfortunately, as the size of any directional sound pressure sensor is reduced, the difference in the two sensed pressures also diminishes. This means that in approaches employing two microphones, the difference in the signals becomes very small relative to the common mode or average pressure. This small difference is also very sensitive to small differences in the response characteristics of the microphones, hence there is a requirement for careful matching.

Because the spacing 118 between the sound ports in directional microphones is typically much smaller than the sound wavelength, the difference in the detected pressures also diminishes as the frequency decreases, or equivalently, as the wavelength increases.

FIG. 2*b* shows the measured frequency response of the Etymotic D-mic, a directional microphone used in hearing aids (not shown). The loss of sensitivity at low frequencies is shown in the curve labeled "Directional Microphone—Low Cut" 120 which is the uncompensated response of this microphone. This curve shows a 6 dB/octave high-pass filter characteristic typical of directional microphones. This response is typically compensated using a 6 dB/octave low-pass filter along with gain to achieve the "Flat" response shown in the "Directional Microphone—Flat" curve 122 of FIG. 2*b*. While such electronic compensation achieves the desirable frequency response, the roughly 30 dB of gain needed at low frequencies also dramatically amplifies the microphone self-noise.

Therefore, the increase in noise and loss of sensitivity in miniature directional microphones limits their applicability and precludes their use in high-performance systems.

The directional acoustic sensing concepts described hereinabove are considered "first-order" differential microphones because they rely on an estimate of the pressure gradient through a measurement of the simple difference in pressure at two points. The directivity pattern of first-order differential microphones is the well-known figure eight pattern. The amplitude of the response is proportional to $\cos(\theta)$, where $\theta$ is the propagation direction relative to the line that connects the pressure measurement points. If $\theta=\pi/2$, the response will be at a minimum or a null. Along with the figure eight directivity pattern, it is common to either introduce a small delay in one of the pressure signals, or combine the pressure difference with a measurement of the pressure to obtain a wide range of first-order directivity patterns ranging from omnidirectional to cardioid or hypercardioid.

While first-order directional microphones have proven very beneficial in a large number of applications, there is great potential for dramatic improvements in performance through the use of second (and higher) order microphone systems. A second-order differential pressure sensing scheme can be schematically represented by the arrangement shown in FIG. 3. This system consists of three omnidirectional microphones 126, 128, 130, separated from each other by a distance, d 132. Microphones 126, 128, 130 generate output signals S1, S2, and S3, respectively. Two difference signals, S1−S2 and S3−S2 may be computed. The difference between these two difference signals is S1−2S2+S3. As shown below, while the output of a first-order pressure gradient sensor is proportional to $\cos(\theta)$, the output of a second-order sensor is proportional to $\cos^2(\theta)$, giving a much stronger dependence on $\theta$ and, consequently, a much greater ability to reject unwanted sounds.

To illustrate the directivities and frequency responses of first- and second-order differential pressure sensors, assume that a plane harmonic wave of amplitude P having a frequency $\omega$ is propagating with speed c at an angle $\theta$ relative to the line connecting the microphones. If the location of S2 (i.e., the signal generated by microphone 128) is chosen to be the origin, then the pressures measured by the three microphones 126, 128, 130 in FIG. 3 may be expressed as $S_1=Pe^{i(\omega t+kd)}$, $S_2=Pe^{i\omega t}$, and $S_3=Pe^{i(\omega t-kd)}$, where $k=(\omega/c)\cos(\theta)$. The output of the second-order sensor is then:

$$S_1-2S_2+S_3=Pe^{i\omega t}(e^{ikd}+e^{-ikd}-2)=2Pe^{i\omega t}(\cos(kd)-1)$$

$$\approx Pe^{i\omega t}(kd)^2=Pe^{i\omega t}\omega^2\cos^2(\theta)(d/c)^2 \quad (1)$$

A first-order differential pressure sensor could be formed as in FIG. 1 where only the difference between S1 and S2 is taken:

$$S_1-S_2=Pe^{i\omega t}(e^{ikd}-1)\approx Pe^{i\omega t}ikd=Pe^{i\omega t}i\omega\cos(\theta)(d/c) \quad (2)$$

The results of Equations (1) and (2) show the difference in the dependence on the angle of incidence, $\theta$. The directivity patterns 134, 136 of first and second-order pressure gradient microphones, respectively, are compared in FIG. 4. By observing FIG. 4, it may be seen that the $\cos^2(\theta)$ dependence of the second-order sensor gives it better rejection of off-axis sounds (i.e., for angles other than zero or 180°) than the first-order sensor, which depends on $\cos(\theta)$. This substantially sharper directivity pattern results in greatly enhanced rejection of unwanted signals.

While the directionality of higher-order differencing schemes can be significantly superior to those of first-order systems, several practical difficulties have hampered their application in commercial products. Along with the dramatic difference in directionality illustrated in Equations (1) and (2), it should also be readily observed that the two sensors have markedly different dependencies on the sound frequency, $\omega$.

As may be seen in FIG. 2*b*, the frequency response of first-order directional microphones has a 6 dB/octave high-pass filter characteristic with a corner frequency that is equal to the first resonant frequency of the microphone diaphragm. This filter shape is due to the linear dependence on $\omega$ shown in Equation (2). The gain needed to compensate for the loss of low-frequency signals results in a substantial degradation in the noise performance of first-order microphones. Unfortunately, a second-order differential (or directional) microphone typically has a high-pass frequency response with a 12 dB/octave slope. This is because the second-order difference obtained in Equation (1) depends on $\omega^2$. The dramatic attenuation of low-frequency sounds often causes these signals to be lost in the noise of the system.

The predicted frequency responses of omnidirectional and first- and second-order differential microphones are compared in FIG. 5, curves 134, 136, and 138, respectively. These results assume that each microphone has a resonant frequency of 5 kHz (similar to the microphone used in the results shown in FIG. 2*b*. The responses are normalized so that they are unity (or zero dB) at the microphone's resonant frequency. FIG. 5 illustrates the dramatic loss of sensitivity of the second-order microphone at frequencies that are much below resonance.

In addition to the differences in directivity and frequency response of the first- and second-order pressure differences described in Equations (1) and (2), it is also apparent that as the size of the sensor diminishes, i.e., as d is reduced, the sensitivity of the second-order sensor suffers more than the first-order sensor. This is because d is linear in Equation 2 but is squared in Equation (1). This loss in sensitivity with diminishing size or aperture adds a further challenge to the design of miniature directional acoustic sensors.

In spite of the extreme challenges in overcoming the low sensitivity and poor frequency response of second-order microphones, the improvement in directivity depicted in FIG. 4 indicates there is a very substantial payoff if a practical design can be developed. One object of the present invention is to provide a silicon microphone diaphragm that achieves this.

The improvements in the technology of acoustic sensing provided by the present invention may have a profound impact on a number of industries. The ability to construct very small, low-cost acoustic sensors that are highly directional can result in dramatic performance improvements in products that deal with acoustic communication and will open doors to the creation of new, compact and low-cost devices that sense the location of sound sources.

One industry that may be significantly enhanced by this technology is the hearing aid industry. An extremely common complaint of hearing aid users continues to be that they have great difficulty understanding speech in noisy environments. Of all available technologies, the use of directional microphones has shown the most promise for addressing this problem. A number of clinical studies of the hearing impaired have demonstrated improvements in speech intelligibility in noise from the use of directional microphones. Despite the ample evidence that directional microphones play a crucial role, only very modest improvements in their performance have so far been observed. It is believed that many engineering challenges still stand in the way of directional microphones achieving their full potential.

Along with producing greatly improved devices for the hearing impaired, the present invention may also enable the development of other advanced consumer products such as directional microphones for telephones, computers, portable digital devices, camcorders, and surveillance systems. All of these products will benefit from the incorporation of miniature directional microphones.

SUMMARY OF THE INVENTION

In accordance with the present invention there is provided a miniature microphone diaphragm having a response that is highly dependent on the direction of the incident sound. A primary advantage of the inventive microphone diaphragm over existing approaches is that the inventive concept enables the fabrication of single, miniature microphone diaphragms that achieve a second-order (or higher-order) directional response. This may lead to the development of highly innovative microphones having far greater directionality, better sensitivity, wider frequency response, and lower noise than is achievable with current technology.

It is therefore an object of the invention to provide a miniature microphone diaphragm that provides second- and higher-order differential pressure sensing.

It is another object of the invention to provide a miniature microphone diaphragm made from silicon.

It is an additional object of the invention to provide a miniature microphone diaphragm based on taking maximum advantage of the structural properties of silicon.

It is a further object of the invention to provide a miniature microphone diaphragm constructed using silicon microfabrication techniques.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

The present invention provides improved, miniature microphone diaphragms. A first-order directional microphone diaphragm is first described.

The present invention provides an extension of a new approach developed for the design of differential microphones inspired by the inventors' previous discovery of a novel mechanism for directional hearing in the parasitoid fly, Ormia ochracea, which is the subject of our co-pending '664 patent application.

Figure 6A:
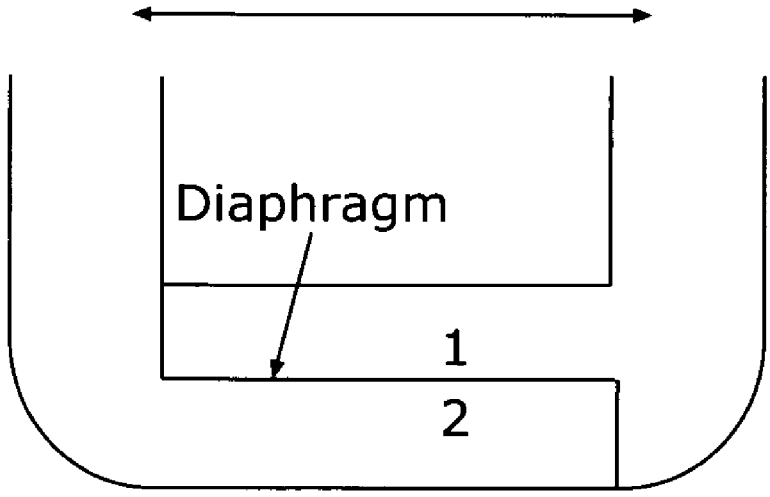
FIG. 6*a* is a cross-sectional, schematic view of a conventional differential microphone diaphragm of the prior art.
Figure 6B:
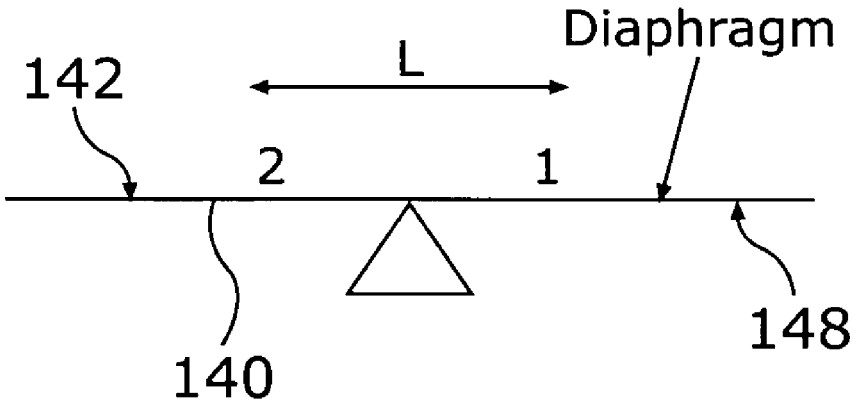
FIG. 6*b* is a schematic diagram of the first-order differential silicon microphone diaphragm of the invention.

In the conventional differential diaphragm (FIG. 6*a*), the two pressures act on the top and bottom surfaces of a simple membrane. In the approach of the present invention as well as that of the co-pending '664 application (FIG. 6*b*), the two pressures 142, 144 act on the top surface of either side of diaphragm 140 and produce a rocking motion. This novel approach offers both a host of design possibilities and the potential of radically improved microphone diaphragm performance. The primary object of the present invention is to extend the first-order differential pressure-sensing concept illustrated in FIG. 6*b*, as described in the co-pending '664 application, to create a microphone diaphragm that achieves second- and higher-order differential pressure sensing.

A primary advantage of the design approach is that it enables the creation of almost any desired stiffness of the diaphragm through the proper design of the support at the pivot. The only ways to adjust the stiffness of a conventional diaphragm, essentially a plate or membrane, are to adjust its thickness or change its initial tension. Reducing the diaphragm's stiffness through the reduction of the diaphragm thickness introduces a host of fabrication difficulties and raises concerns over the device's durability. The frequency response of the diaphragm will also suffer since its thickness is reduced, as unwanted resonances may appear in the frequency range of interest. Because the novel design consists of a stiffened plate on a carefully designed hinge, it can be designed so that any unwanted resonances are well above the frequencies of interest.

It is well known that in order for any promising sensor concept to have an impact in the commercial market, it is essential that great care be taken at the outset of the design process to ensure the resultant sensor is ultimately fabricated in a cost-effective manner. The inventive designs readily lend themselves to the use of silicon microfabrication techniques, therefore greatly increasing their potential for low-cost manufacture, since they would use a minimum of human labor.

It is generally believed that the biggest challenge by far in fabricating microphones out of silicon (or other materials used in microfabrication) is the reduction of the influence of stress on the structural integrity and dynamic properties of the microphone diaphragm. Unfortunately, due to the micromechanical properties of the materials used, the fabrication process typically results in a significant amount of stress in the diaphragm that can be sufficient to result in fracture of a significant percentage of the devices before the fabrication is complete. In addition, the stress is strongly dependent on the specific details of the fabrication process that has heretofore been almost impossible to sufficiently control. Along with causing failures due to fracture, stress (either tensile or compressive) can have a marked detrimental influence on the dynamic response of these very thin plates.

Myriad approaches have been developed to reduce the effects of stress on silicon microphones including the use of corrugations and stress relieving supports. Such techniques are known to those of skill in the silicon microfabrication arts. The design approaches used in making existing silicon microphones have heretofore typically involved making capacitive microphones comprising a thin flexible diaphragm along with a capacitive back plate, more or less identical to that used in larger microphones, but fabricating a diaphragm having small dimensions from silicon. The approach of the present invention is a radical departure from such scaling down of conventional microphones and is based on taking maximum advantage of the structural properties of silicon.

First-Order Microphone Diaghragm Fabrication Results

A first-order differential diaphragm design as described in the co-pending '664 application, consists of a miniature, stiffened plate that is supported on two torsional springs along its midline. Typically, the overall dimensions are approximately 1 mm by 2 mm. The diaphragm is made out of 2 $\mu$m thick polycrystalline silicon. The microphone design using this particular diaphragm is intended to employ a backplate for capacitive sensing with an intended gap of 5 $\mu$m between the diaphragm and the backplate.

Differential Microphone Concept

Figure 7:
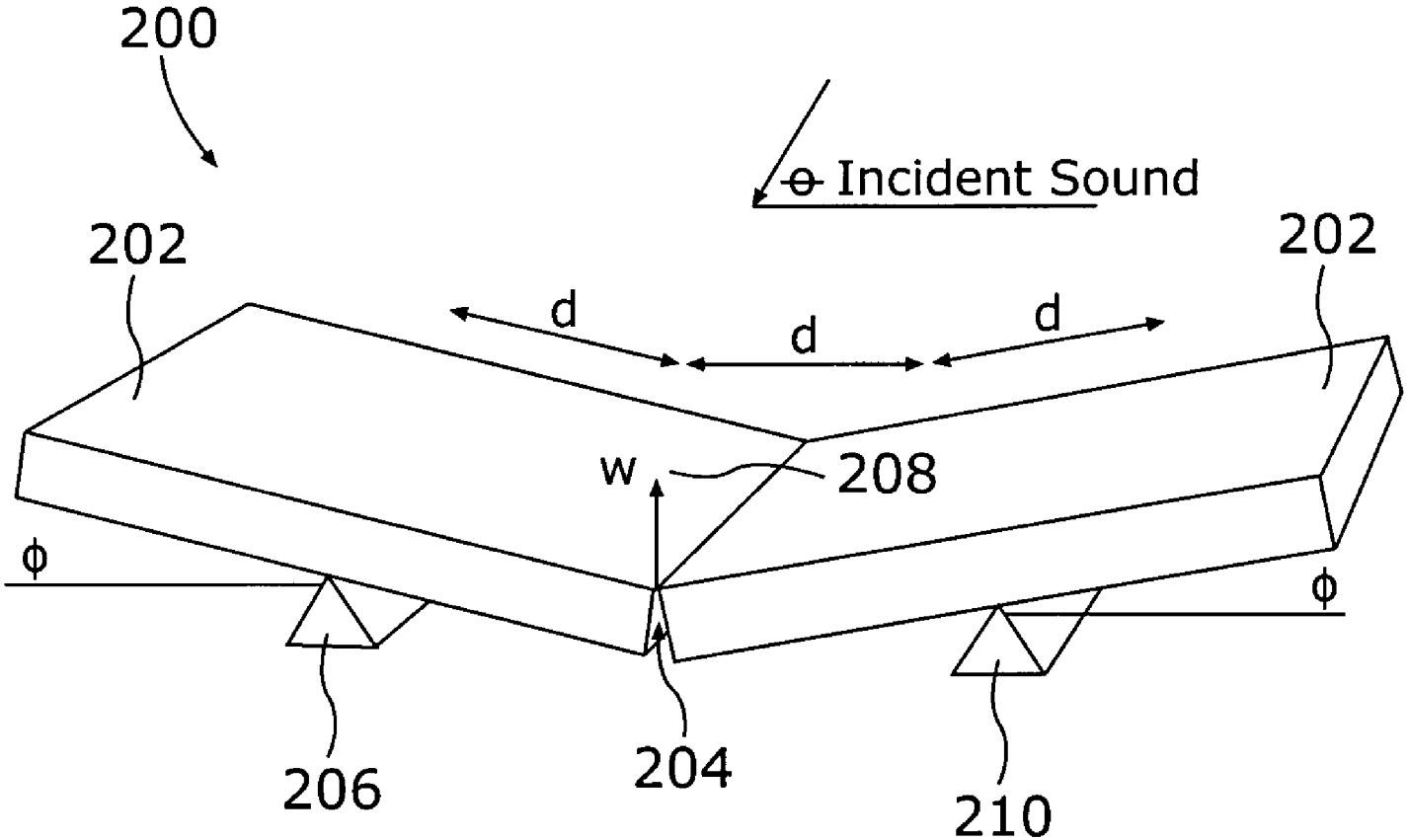
FIG. 7 is a schematic representation of the second-order microphone diaphragm of the invention.

A second-order differential microphone concept that builds on the first-order microphone design described hereinabove is shown in FIG. 7, generally at reference no. 200. The present invention consists of two first-order differential diaphragms 202 that are joined together with a flexible hinge 204. The hinge 204 must be designed so that it constrains the transverse deflections of the ends of diaphragms 202 to be substantially identical. The torsional stiffness of the hinge 204 (along with that of each pivot point 206) must be designed so that the resonant frequency of the structure is below a desired frequency of operation.

Figure 1:
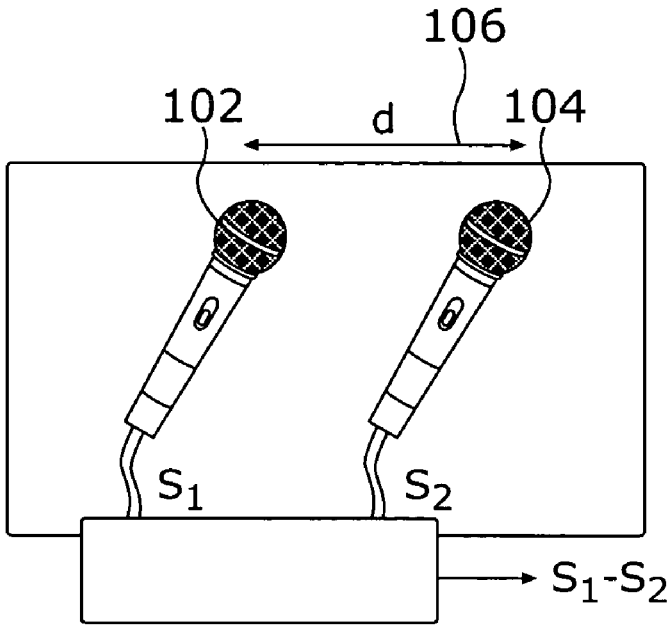
FIG. 1 is a pictorial schematic diagram showing a pair of non-directional microphones.
Figure 2A:
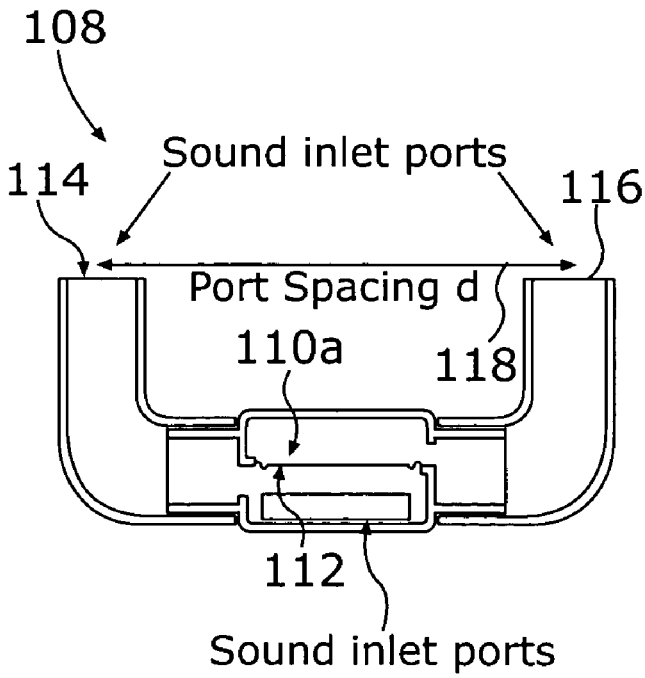
FIG. 2*a* is a cross-sectional, schematic diagram of a simple pressure gradient microphone.
Figure 2B:
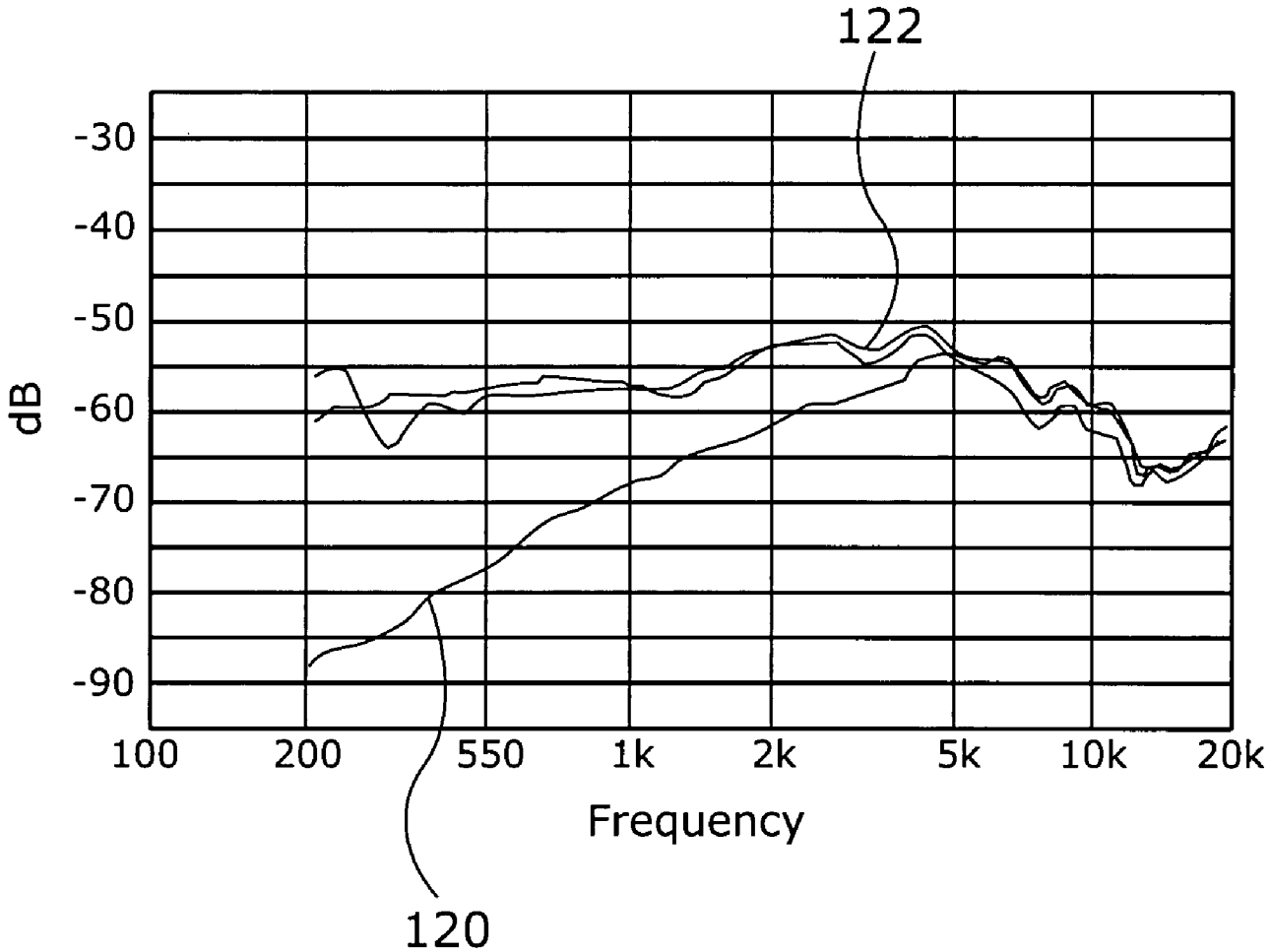
FIG. 2*b* is a graph of frequency response of an omnidirectional, an uncompensated directional, and a compensated directional microphone.
Figure 3:
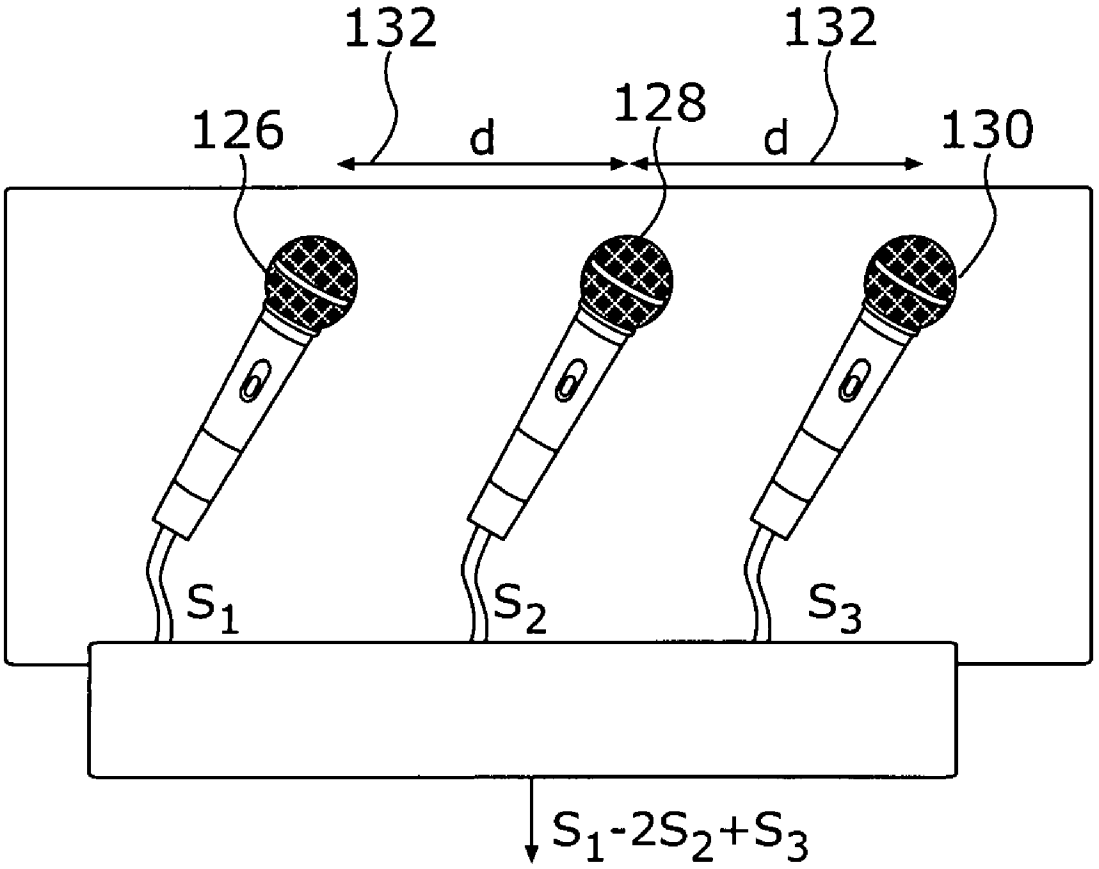
FIG. 3 is a pictorial schematic diagram showing three non-directional microphones.

The design and fabrication techniques for the second-order diaphragm 200 are similar to the highly successful approach we have developed for the first-order diaphragms. The acoustic response of the structure shown in FIG. 7 is proportional to the second-order difference in the acoustic pressure, in a manner that is directly analogous to the system of FIG. 3. This can be seen by considering a simplified model of the response of the inventive diaphragm 200. An initial model of the diaphragm 200 can be constructed by assuming that the two diaphragms 202 are identical plates that move as rigid bodies about their hinges 204 and the hinge 204 that joins them at the center constrains them to have the same displacement at that point, w 208, as shown in FIG. 7. The motion of the diaphragm 200 can be described using either w or the rotation $\phi$ as a generalized coordinate. The governing equation in terms of the rotation $\phi$ is:

$$2I\ddot{\phi}+2k_\phi+C\dot{\phi}+Q \tag{3}$$

where I is the mass moment of inertia of each of the two rigid first-order diaphragms, $2k_t$ is the equivalent torsional stiffness, C is the equivalent viscous damping in the system, and Q is the moment due to the incident sound pressure.

It may be shown that the moment that acts on the diaphragm 200 has a second-order directivity. To express Q in terms of the applied sound pressure, note that the virtual work in the system is $\delta W=Q\delta\phi$. The virtual work done by the sound pressure, p(x,t) is:

$$\delta W = \int_{-2d}^{2d} bp(x,t)\delta w(x,t)\,dx, \tag{4}$$

where b is the width of the diaphragm, w(x,t) is the deflection at any point, and x=0 is at the central hinge.

The sound pressure due to a traveling harmonic plane wave may be expressed as:

$$p(x,t)=Pe^{i(\omega t-kx)}$$

where $k=(\omega/c)\cos(\theta)$, $i=\sqrt{-1}$, c is the sound speed, and ω is the frequency.

Because the coupled diaphragms 202 are designed to behave as rigid bodies, that geometric constraint enables the relation w(x,t) to ϕ and x as:

$$w(x,t)=-(x+d)\phi \text{ for } x<0 \text{ and } w(x,t)=(x-d)\phi \text{ for } x>0. \tag{5}$$

Substitution of equation (5) into (4) allows expressing the virtual work using ϕ as a generalized coordinate:

$$\begin{aligned}\delta W &= bPe^{i\omega t}\left(-\int_{-2d}^{0} e^{-ikx}(x+d)\delta\phi\,dx + \int_{0}^{2d} e^{-ikx}(x-d)\delta\phi\,dx\right) \\ &= bPe^{i\omega t}2i\sin(kd)\left(\frac{(2d)\cos(kd)}{ik} + \frac{2i\sin(kd)}{k^2}\right. \\ &\approx -\frac{4}{3}k^2d^4bPe^{i\omega t}\delta\phi\end{aligned} \tag{6}$$

where δ is the variational operator.

It has been assumed that the device is small so that kd<<1. Since δW=Qδϕ and $k=(\omega/c)\cos(\theta)$, equation (6) gives:

$$Q\approx -4\Omega^2/(3c^2)\cos^2(\theta)d^4bPe^{i\omega t} \tag{7}$$

Figure 4:
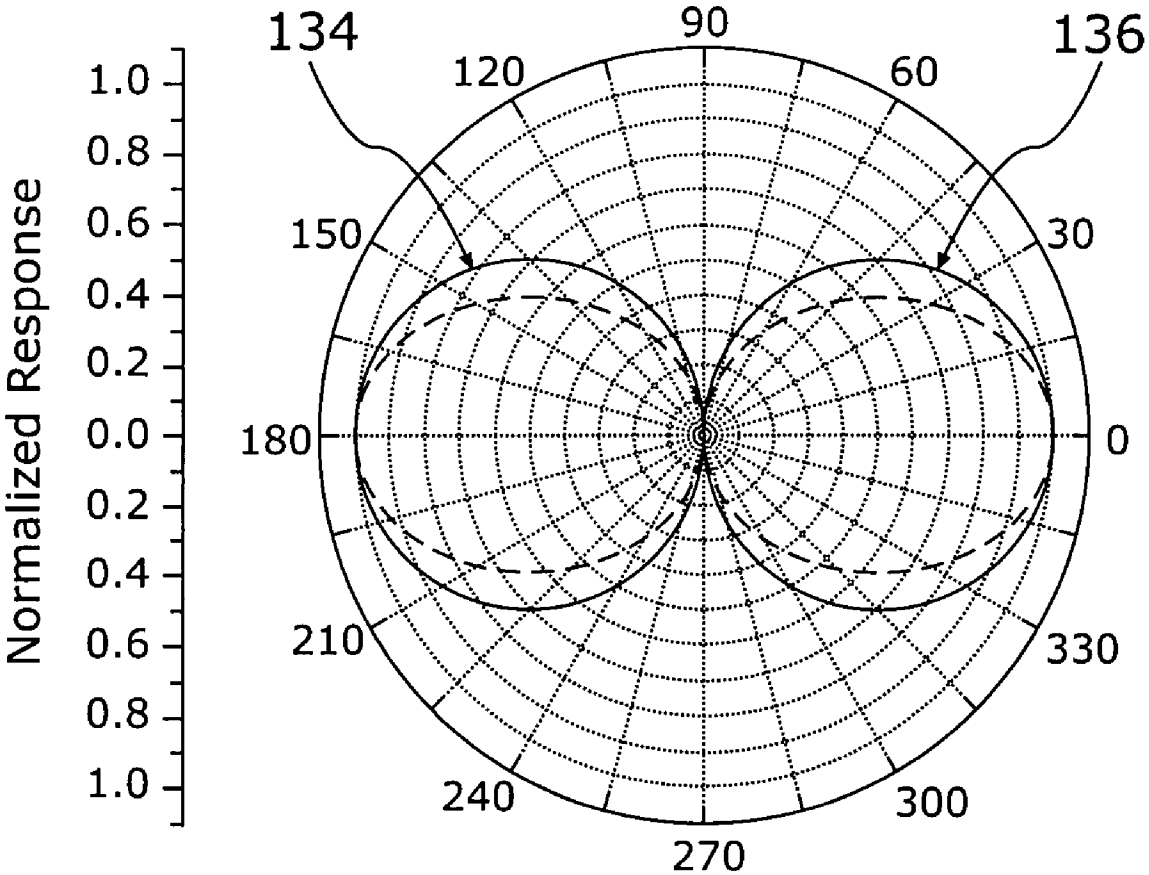
FIG. 4 is a polar directivity plot of first-order and second-order pressure gradient microphones.
Figure 5:
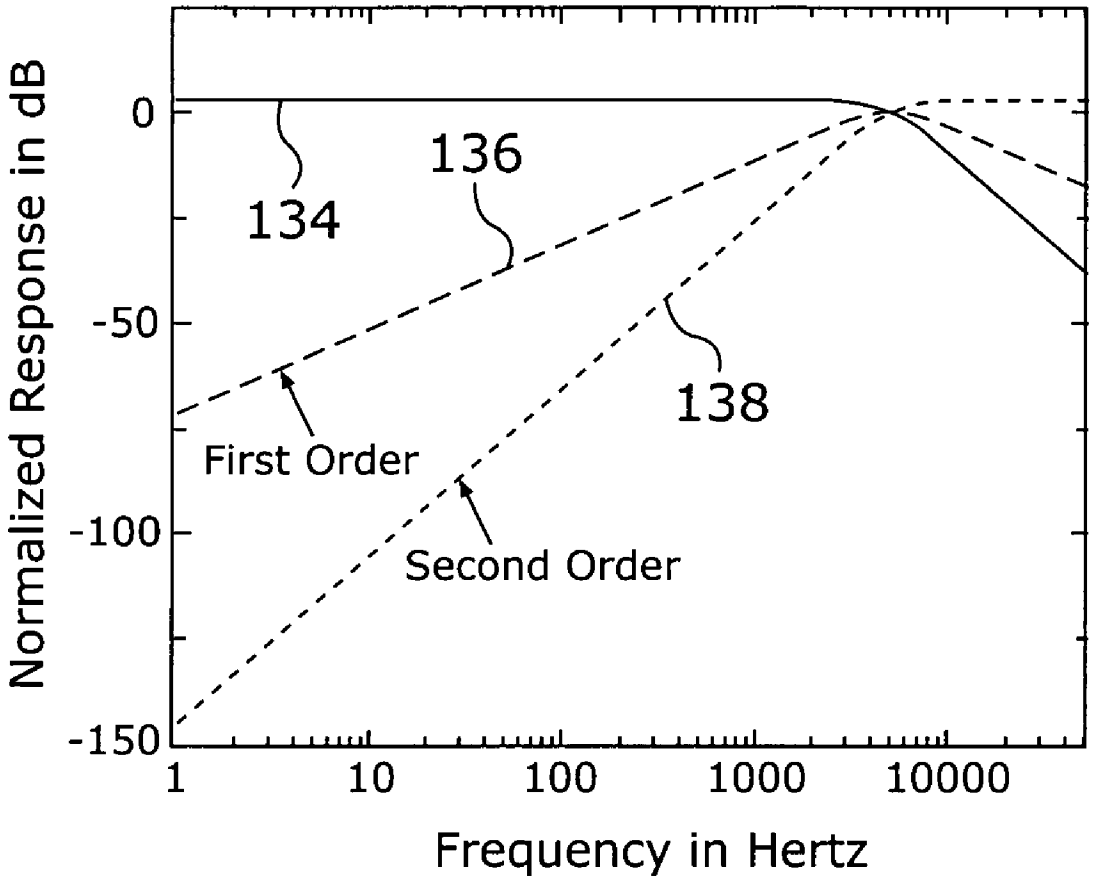
FIG. 5 is a graph of frequency response for omnidirectional and first- and second-order directional microphones.

Substitution of equation (7) into (3) enables solving for the rotation as:

$$\phi = -\frac{2\omega^2/(3Ic^2)\cos^2(\theta)d^4bPe^{i\omega t}}{\omega_0^2-\omega^2+2\omega\omega_0\zeta i} \tag{8}$$

where the natural frequency is $\omega_0\sqrt{k_1/I}$ and ζ is the damping ratio. The response as predicted by equation (8) is thus proportional to $\cos^2(\theta)$ and therefore has the second-order directivity pattern shown in FIG. 4. Note that equation (8) may also be used to compute the deflection at the central hinge 204 by using w=w(0,t)=−dϕ. If the resonant frequency of the structure can be designed to be well below the frequencies of interest so that $\phi_0<<\omega$, then equation (8) becomes:

$$\phi \approx \frac{2}{3Ic^2}\cos^2(\theta)d^4bPe^{i\omega t} \tag{9}$$

Equation (9) shows that for frequencies well above resonance, the response is independent of frequency. Preliminary results indicate that practical designs can be made having resonant frequencies as low as about 300 Hz.

A Higher-Order Diaphragm

Figure 8:
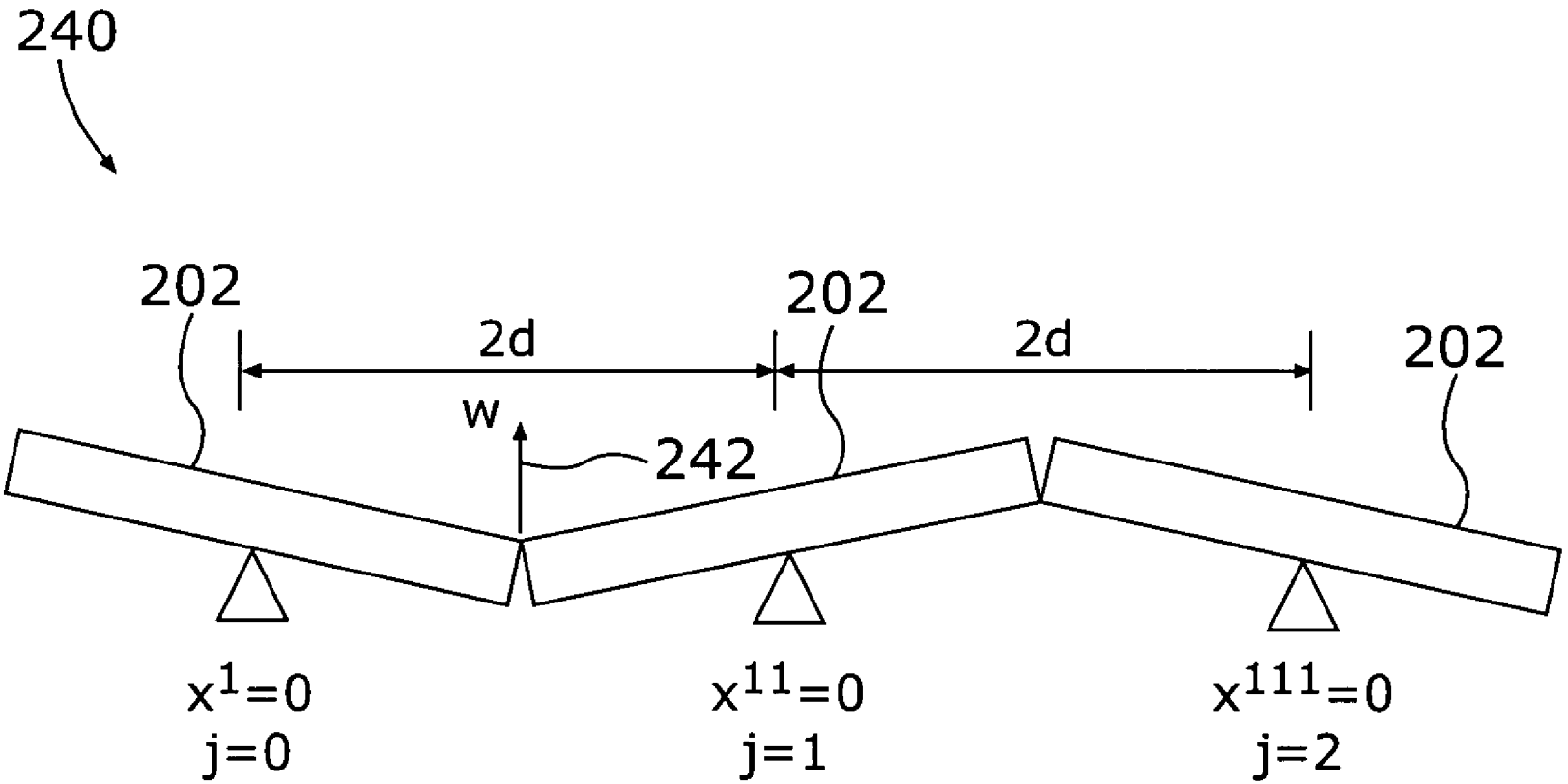
FIG. 8 is a schematic representation of the higher-order microphone diaphragm of the invention.

This approach described for second-order microphone diaphragms may be easily extended to higher-order differential microphone diaphragms. Refer now to FIG. 8. For higher order diaphragms, it is convenient to choose a new coordinate system that has its origin at the left-most hinge 206 in the second-order diaphragm shown in FIG. 7. Now, consider a diaphragm array 240 that consists of three coupled first-order diaphragms 202. It will be recognized that while three first-order diaphragms 202 have been chosen for purposes of disclosure, the inventive concept may be extended to any number of hinged first-order diaphragms 202. The transverse deflection, w 242, of any point on the array can be related to the rotation angle, ϕ, which is assumed to be positive in the counterclockwise direction. By examining FIG. 8, the deflection can be written as:

$$w(x^1+j2d)=-x^1\phi \text{ for j even,} \tag{10}$$

$$w(x^1+j2d)=x^1\phi \text{ for j odd.} \tag{11}$$

Equations (10) and (11) can be generalized in the form:

$$w(x^1+j2d)=-(-1)^j x^1\phi \text{ for any j} \tag{12}$$

The acoustic pressure is:

$$p(x^1+j2d,t)=Pe^{i\omega t}e^{-ik2jd}e^{-ikx^1}. \tag{13}$$

For an array containing n elements, the virtual work done by the sound pressure may be written as:

$$\delta W = \sum_{j=0}^{n}\int_{-d}^{d} bp(x^1+j2d,t)\delta w(x^1+j2d,t)\,dx^1 \tag{14}$$

Substituting equations (12) and (13) into (14) gives:

$$\begin{aligned}\delta W &= \sum_{j=0}^{n}\int_{-d}^{d} bPe^{i\omega t}e^{-ik2jd}e^{-ikx^1}(-(-1)^j)x^1\delta\phi\,dx^1 \\ &= -\sum_{j=0}^{n} b\delta\phi Pe^{i\omega t}e^{-ik2jd}(-(-1)^j)\int_{-d}^{d} e^{-ikx^1}x^1\,dx^1 \\ &= b\delta\phi Pe^{i\omega t}\left\{\frac{2d\cos(kd)}{ik}+\frac{2i\sin(kd)}{k^2}\right\}\sum_{j=0}^{n} e^{-ik2jd}(-(-1)^j)\end{aligned} \tag{15}$$

Recall that $k=(\omega/c)\cos(\theta)$, so that equation (15) depends on the angle of incidence, θ. By manipulating equation (15) it may also be shown that the force on the diaphragm has a stronger dependence on θ as n is increased.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims:

1. A miniature differential microphone, comprising:

at least a pair of substantially rigid diaphragm segments each having two opposing surfaces and two opposing edges, said opposing edges being substantially parallel to one another, at least one of said two opposing edges of each of said at least a pair of diaphragm segments defining a hinge edge, each of said at least a pair of diaphragm segments being disposed adjacent one another with one of said at least one hinge edge thereof being aligned proximate and substantially parallel to said at least one hinge edge of another of said at least a pair of diaphragm segments;

a first hinge fixedly attached to each adjacent one of said at least one hinge edge of each adjacent pair of said at least a pair of diaphragm segments disposed to flexibly join adjacent ones of said at least one hinge edges;

a second hinge located beneath a lower one of said two opposing faces and positioned substantially centrally thereupon and substantially parallel to each of said two hinge edges.

2. The miniature differential microphone as recited in claim 1, wherein said at least two diaphragm segments are substantially identical to one another.

3. The miniature differential microphone as recited in claim 1, wherein each of said at least two diaphragm segments are dimensioned in the range of approximately 1 mm×2 mm and each have a thickness in the range of approximately 2 •m.

4. The miniature differential microphone as recited in claim 1, wherein each of said at least two diaphragm segments comprise polycrystalline silicon.

5. The miniature differential microphone as recited in claim 4, wherein each of said at least two diaphragm segments are constructed using silicon microfabrication techniques.

* * * * *